US010148070B2

(12) United States Patent
Sato et al.

(10) Patent No.: US 10,148,070 B2
(45) Date of Patent: Dec. 4, 2018

(54) MACHINING APPARATUS, COMPONENT PRODUCING METHOD, AND SPARK PLUG PRODUCING METHOD

(71) Applicant: NGK SPARK PLUG CO., LTD., Nagoya-shi, Aichi (JP)

(72) Inventors: Kimiaki Sato, Komaki (JP); Hajime Kawano, Konan (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/907,746

(22) Filed: Feb. 28, 2018

(65) Prior Publication Data

US 2018/0254614 A1 Sep. 6, 2018

(30) Foreign Application Priority Data

Mar. 1, 2017 (JP) ..... 2017-038131

(51) Int. Cl.
*H01T 21/02* (2006.01)
*H01T 13/58* (2011.01)

(52) U.S. Cl.
CPC ..... *H01T 21/02* (2013.01); *H01T 13/58* (2013.01)

(58) Field of Classification Search
CPC ..... H01T 21/02; H01T 21/00; H01T 13/58
See application file for complete search history.

(56) References Cited

U.S. PATENT DOCUMENTS 4,942,752 A * 7/1990 Helfman ..... B21H 3/042 470/209
2009/0007618 A1* 1/2009 Ohashi ..... B21H 3/042 72/88
2011/0183573 A1* 7/2011 Ozeki ..... B21H 3/04 445/7
2015/0165512 A1* 6/2015 Gutsche ..... B21H 3/046 72/37
2015/0258600 A1* 9/2015 Zhou ..... B21H 3/042 138/109
2016/0107221 A1* 4/2016 Wakazono ..... B21H 3/04 72/88
2018/0169738 A1* 6/2018 Zhou ..... B21H 3/042

FOREIGN PATENT DOCUMENTS

JP 2002-143969 A 5/2002
JP 2002143969 A * 5/2002

* cited by examiner

*Primary Examiner* — Joseph L Williams
*Assistant Examiner* — Jose M Diaz
(74) *Attorney, Agent, or Firm* — Kusnar & Jaffe

(57) ABSTRACT

A measuring device that includes a base having a base reference surface to which a workpiece reference surface is opposed, measures a gap in an axial direction between the base reference surface and the workpiece reference surface by use of a fluid flowing between the base reference surface and the workpiece reference surface, in a state where the workpiece reference surface is opposed to the base reference surface. Dice, a distance to which in the axial direction from the base reference surface is known, form the external thread on the axial portion toward a direction away from the flange portion through rolling. A calculation device obtains a target position, in the axial direction, of the workpiece to be disposed on the dice, on the basis of the known distance and the measured gap.

4 Claims, 5 Drawing Sheets

MACHINING APPARATUS, COMPONENT PRODUCING METHOD, AND SPARK PLUG PRODUCING METHOD

RELATED APPLICATIONS

This application claims priority from Japanese Patent Application No. 2017-038131 filed on Mar. 1, 2017, the entire contents of which are incorporated herein by reference.

FIELD OF THE INVENTION

The present invention relates to a machining apparatus, a component producing method, and a spark plug producing method, and particularly to a machining apparatus, a component producing method, and a spark plug producing method which allow an external thread to be formed through rolling.

BACKGROUND OF THE INVENTION

A metal shell of a spark plug is assembled to an insulator holding a center electrode, and an external thread is formed on an axial portion, of the metal shell, to which a flange portion is provided. The spark plug is attached to an engine by the external thread of the metal shell being screwed into a screw hole of the engine. The flange portion of the metal shell regulates the amount by which the external thread is screwed into the engine. The spark plug attached to the engine generates flame kernel in a spark gap between the center electrode and a ground electrode which is joined to the metal shell. In order to cause flame kernel to grow, the spark plug is preferably attached to the engine such that the spark gap is not hidden behind the ground electrode relative to an air flow generated in a combustion chamber in a compression step that is a pre-ignition step.

Incidentally, as the metal shell of the spark plug is screwed into the engine, the metal shell advances in the axial direction while rotating along a screw helix about the axis, until being regulated by the flange portion. The position of the ground electrode in the circumferential direction of the metal shell is determined at a position where the axial movement of the external thread is regulated by the flange portion. Therefore, the position of the ground electrode in the circumferential direction of the metal shell is dependent on the distance in the circumferential direction between the ground electrode and the cutting-start position of the external thread, and on the distance in the axial direction from the flange portion to the ridge of the external thread.

Japanese Patent Application Laid-Open (kokai) No. 2002-143969 discloses a technique for forming, through rolling, an external thread on an axial portion of a workpiece to which a ground electrode is joined. In this technique, in a state where a cutting-start position, in the circumferential direction, of the external thread is set, the distance in the axial direction between a flange portion and the cutting-start position of the external thread is set by use of a jig or an optical sensor.

However, in the technique disclosed in Japanese Patent Application Laid-Open (kokai) No. 2002-143969, it is required to reduce variation in the distance in the axial direction from the flange portion to the thread, in order to improve accuracy for the position of the ground electrode to be disposed in a combustion chamber.

The present invention has been made in order to meet the aforementioned need. An advantage of the present invention is a machining apparatus, a component producing method, and a spark plug producing method which enable reduction in variation in the distance in the axial direction from a flange portion and the ridge of a thread.

SUMMARY OF THE INVENTION

In accordance with a first aspect of the present invention, there is provided a machining apparatus that forms, through rolling, an external thread on an axial portion of a workpiece which includes the axial portion, and a flange portion protruding in an axial orthogonal direction orthogonal to an axial direction of the axial portion so as to be flange-shaped. A measuring device which includes a base having a base reference surface to which a workpiece reference surface, on an axial portion side, of the flange portion is opposed, measures a gap in the axial direction between the base reference surface and the workpiece reference surface by use of a fluid flowing between the base reference surface and the workpiece reference surface, in a state where the workpiece reference surface is opposed to the base reference surface. Dice, a distance to which in the axial direction from the base reference surface is known, form the external thread on the axial portion toward a direction away from the flange portion through rolling. A calculation device obtains a target position, in the axial direction, of the workpiece to be disposed on the dice, on the basis of the known distance and the measured gap. A conveying device conveys the workpiece to the target position obtained by the calculation device.

In accordance with a second aspect of the present invention, there is provided a method for forming, through rolling, an external thread on an axial portion of a workpiece which includes the axial portion, and a flange portion protruding in an axial orthogonal direction orthogonal to an axial direction of the axial portion so as to be flange-shaped. In a surface-opposing step, a workpiece reference surface, on an axial portion side, of the flange portion is caused to oppose a base reference surface of a base. In a measurement step, a gap in the axial direction between the base reference surface and the workpiece reference surface is measured by use of a fluid flowing between the base reference surface and the workpiece reference surface, in a state where the workpiece reference surface is opposed to the base reference surface. In a calculation step, a target position, in the axial direction, of the workpiece to be disposed on dice, a distance to which in the axial direction from the base reference surface is known, is obtained on the basis of the known distance and the measured gap. In a conveyance step, the workpiece is conveyed to the target position. In a rolling step, the dice form, through rolling, the external thread on the axial portion of the workpiece disposed at the target position, toward a direction away from the flange portion.

In accordance with a third aspect of the present invention, there is provided a method for producing a spark plug which includes: an insulator having therein an axial hole extending in an axis line direction; a center electrode disposed in the axial hole so as to protrude from a front end of the insulator; a metal shell surrounding a periphery of the insulator; and a ground electrode provided such that a proximal end thereof is connected to a front end of the metal shell and such that a distal end thereof is opposed to a tip of the center electrode with a gap being retained therebetween. As the metal shell, a metal shell produced by the component producing method is used.

In the machining apparatus as described above, the measuring device measures the gap in the axial direction between the base reference surface and the workpiece reference surface. On the basis of the measured gap and the known distance in the axial direction between the base reference surface and the dice, the calculation device obtains the target position, in the axial direction, of the workpiece to be disposed on the dice. The conveying device conveys the workpiece to the target position obtained by the calculation device. The dice form, by rolling, the thread on the axial portion toward a direction away from the flange portion. The measuring device measures the gap by use of a fluid flowing between the base reference surface and the workpiece reference surface, whereby the accuracy for measurement of the gap can be improved. Consequently, variation in the distance in the axial direction between the workpiece reference surface of the flange portion and the ridge of the thread can be reduced.

In the machining apparatus as described above, positive-pressure gas is used as the fluid. Thus, in addition to the effect of the first aspect, handling of the fluid can be facilitated. Further, even if a foreign object is adhered to the workpiece reference surface, there is a possibility that the foreign object can be removed by the gas when the workpiece reference surface is opposed to the base reference surface.

By the component producing method as described above and a spark plug producing method according to a fourth aspect, the same advantageous effects as those in the first aspect are obtained.

DETAILED DESCRIPTION OF THE INVENTION

Figure 1:
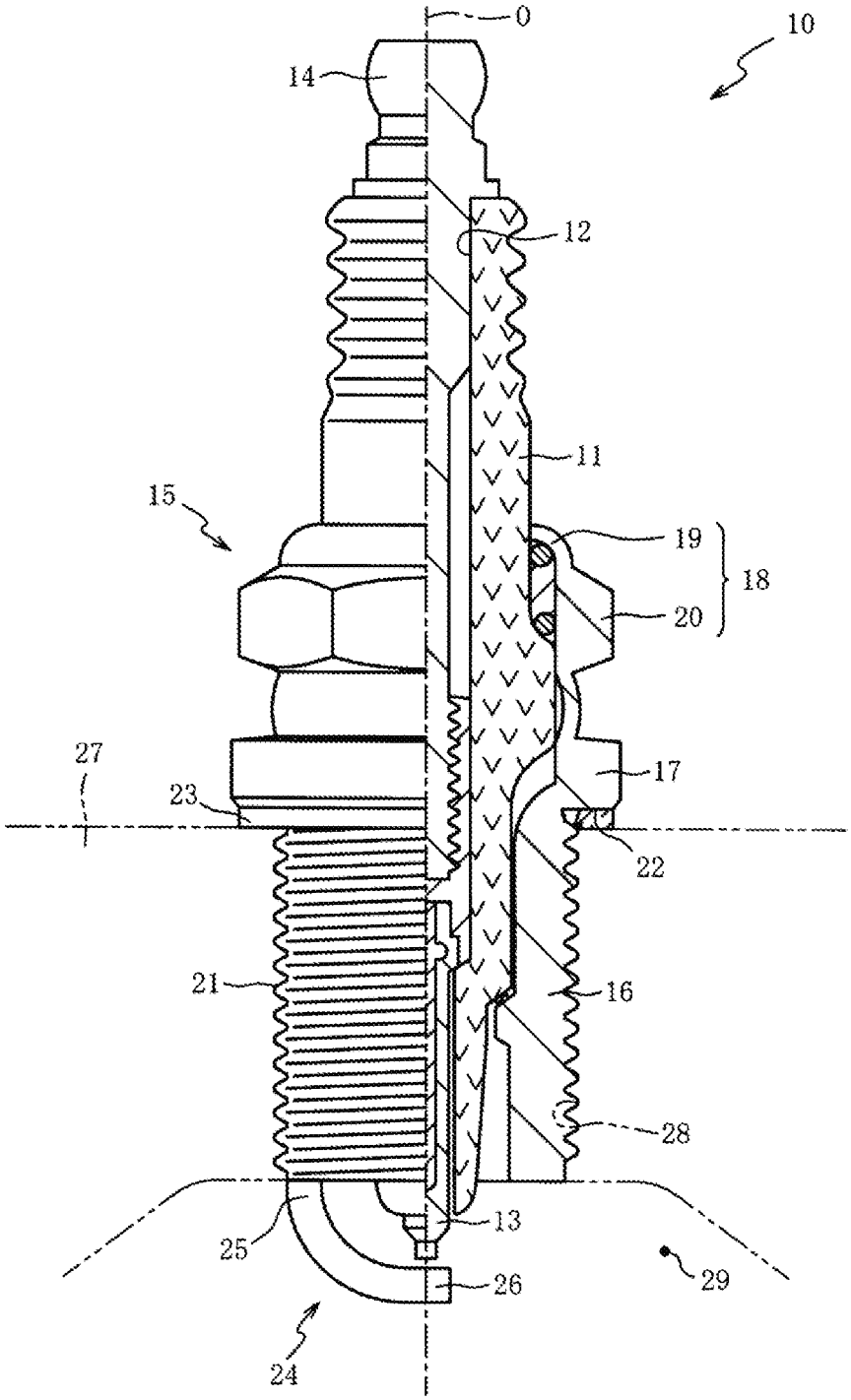
FIG. 1 is a half sectional view of a spark plug.

Hereinafter, a preferred embodiment of the present invention will be described with reference to the accompanying drawings. FIG. 1 is a half sectional view of a spark plug 10, with an axis line O being a boundary. In FIG. 1, the lower side on the drawing sheet is referred to as a front side of the spark plug 10, and the upper side on the drawing sheet is referred to as a rear side of the spark plug 10.

As shown in FIG. 1, the spark plug 10 includes an insulator 11, a center electrode 13, a metal shell 15, and a ground electrode 24. The insulator 11 is a substantially cylindrical member formed of alumina or the like which is excellent in mechanical property and insulation property at high temperature. The insulator 11 has an axial hole 12 which penetrates therethrough along the axis line O.

The center electrode 13 is a rod-shaped electrode which is inserted in the axial hole 12 and held by the insulator 11 so as to extend along the axis line O. The center electrode 13 is disposed in the axial hole 12 so as to protrude from a front end of the insulator 11. In the center electrode 13, a core material having excellent thermal conductivity is embedded in an electrode base material. The electrode base material is formed of an alloy containing Ni as a main ingredient or a metal material made of Ni. The core material is formed of copper or an alloy containing copper as a main ingredient.

A metal terminal 14 is a rod-shaped member to which a high-voltage cable (not shown) is connected, and a front side portion of the metal terminal 14 is disposed in the insulator 11. The metal terminal 14 is electrically connected to the center electrode 13 in the axial hole 12. The metal shell 15 is fixed to a front side portion, on the outer circumference, of the insulator 11 so as to be spaced from the metal terminal 14 in an axis line O direction.

The metal shell 15 is a substantially cylindrical member formed of a metal material (e.g., low-carbon steel or the like) having conductivity. The metal shell 15 includes: an axial portion 16 formed in a cylindrical shape; a flange portion 17 protruding in an axial orthogonal direction orthogonal to an axial direction of the axial portion 16 so as to be flange-shaped; and a tube portion 18 contiguously disposed on a side opposite, in the axial direction, to the axial portion 16 with the flange portion 17 being interposed therebetween. The tube portion 18 includes: a thin portion 19 having a smaller wall thickness than the flange portion 17; and a tool engagement portion 20 protruding radially outward from the thin portion 19.

The axial portion 16 is a portion supporting the insulator 11, and an external thread 21 is formed on the outer circumference of the axial portion 16. The external thread 21 is screwed into a screw hole 28 of an engine 27 so that the metal shell 15 is fixed to the engine 27. The flange portion 17 is a portion for regulating the amount by which the external thread 21 is screwed into the engine 27, and for closing a gap between the external thread 21 and the screw hole 28. In the present embodiment, a gasket 23 is disposed on a workpiece reference surface 22, on an axial portion 16 side, of the flange portion 17. The gasket 23 sandwiched between the flange portion 17 and the engine 27 seals the gap between the external thread 21 and the screw hole 28.

The thin portion 19 is a portion which is plastically deformed to be crimped and fixed to the insulator 11 when the metal shell 15 is mounted on the insulator 11. The tool engagement portion 20 is a portion with which a tool such as a wrench is engaged when the external thread 21 is screwed into the screw hole 28 of the engine 27.

The ground electrode 24 is a rod-shaped member made of a metal (e.g., nickel-based alloy), the member having: a proximal end 25 joined to a front end of the metal shell 15; and a distal end 26 disposed on a side opposite to the proximal end 25. The ground electrode 24 is provided such that the distal end 26 thereof is opposed to the tip of the center electrode 13 with a gap (spark gap) being retained therebetween. In the present embodiment, the ground electrode 24 is bent.

The spark plug 10 is manufactured by the following method, for example. First, a workpiece 60 (refer to FIG. 2) is machined to obtain the metal shell 15. In the workpiece 60, the ground electrode 24 (straight rod material not having been bent) is joined to a front end of the axial portion 16 formed in a tubular shape through cold forging, cutting, or the like. After the external thread 21 is formed on the axial portion 16 of the workpiece 60 through rolling by a machining apparatus 30 (refer to FIG. 2), plating, etc. is performed on the workpiece 60, thereby obtaining the metal shell 15.

In addition, the center electrode 13 is inserted in the axial hole 12 of the insulator 11, and is disposed such that the tip of the center electrode 13 is exposed from the axial hole 12 to the outside. Next, the metal terminal 14 is inserted in the axial hole 12 of the insulator 11, and conduction between the metal terminal 14 and the center electrode 13 is ensured. Next, the insulator 11 is inserted in the metal shell 15, and the thin portion 19 is bent, so that the metal shell 15 is mounted on the insulator 11. Next, the ground electrode 24 is bent such that the distal end 26 thereof is opposed to the center electrode 13, and the gasket 23 is disposed, thereby obtaining the spark plug 10.

As the metal shell 15 of the obtained spark plug 10 is screwed into the screw hole 28 of the engine 27, the metal shell 15 advances in the axial direction while rotating along the helix of the thread about the axis line O, until the gasket 23 disposed on the flange portion 17 comes into close contact with the engine 27. The position of the ground electrode 24 in the circumferential direction of the metal shell 15 mounted to the engine 27 is determined at a position where the axial movement of the external thread 21 is regulated by the flange portion 17 and the gasket 23.

In the spark plug 10 mounted to the engine 27, when high voltage is applied to the metal terminal 14, spark discharge occurs between the distal end 26 of the ground electrode 24 and the center electrode 13, and flame kernel is generated. In order to cause the flame kernel to grow to facilitate ignition of air-fuel mixture, the center electrode 13 is preferably not hidden behind the ground electrode 24 relative to an air flow generated in a combustion chamber 29 in a compression step that is a pre-ignition step.

As long as there is no variation in the thickness of the gasket 23, the position, in the circumferential direction, of the ground electrode 24 relative to the center electrode 13 (axis line O) in a state where the spark plug 10 is mounted to the engine 27, is determined in accordance with the start positions, in the axial direction and the circumferential direction, of the helix of the external thread 21 relative to the workpiece reference surface 22 of the flange portion 17, the start positions being on the flange portion 17 side. Even if the start position, in the circumferential direction of the axial portion 16, of the helix of the external thread 21 is determined, the position, in the circumferential direction, of the ground electrode 24 relative to the center electrode 13 (axis line O) varies once the start position, in the axial direction of the axial portion 16, of the helix of the external thread 21 varies. For example, in a case where the pitch of the external thread 21 is 1.00 mm, when the start position of the helix of the external thread 21 is axially shifted by approximately 28 μm, the position of the ground electrode 24 is shifted by 10° around the axis line O.

Accordingly, in order to improve the accuracy for the position (angle around the axis line O) of the ground electrode 24 relative to the center electrode 13 of the spark plug 10 mounted to the engine 27 thereby to improve the stability of ignition of air-fuel mixture, it is necessary to determine the start position, in the circumferential direction, of the helix of the external thread 21, and, at the same time, improve the accuracy for the start position, in the axial direction, of the helix of the external thread 21.

Figure 2:
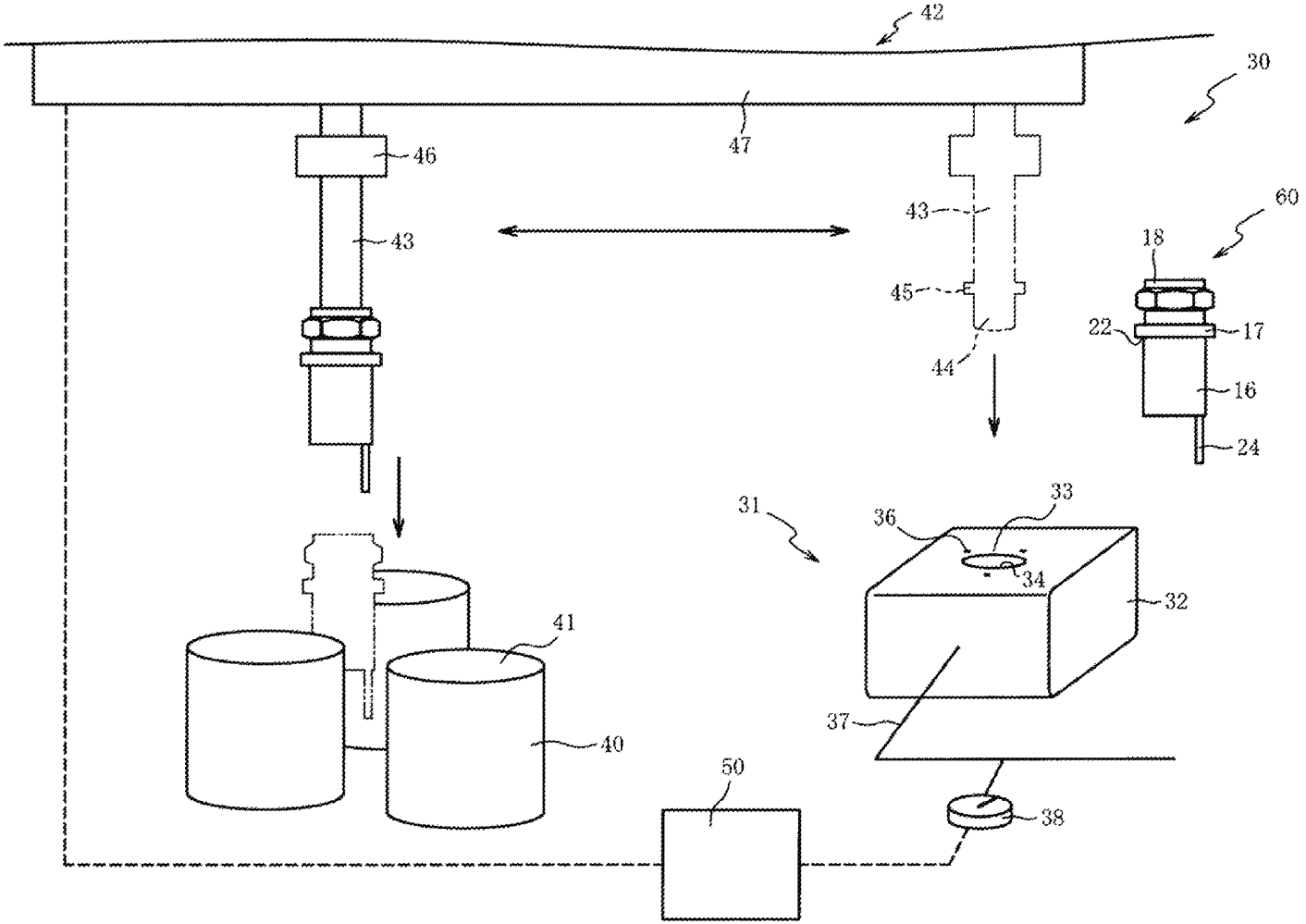
FIG. 2 is a schematic view of a machining apparatus according to one embodiment of the present invention.
Figure 3:
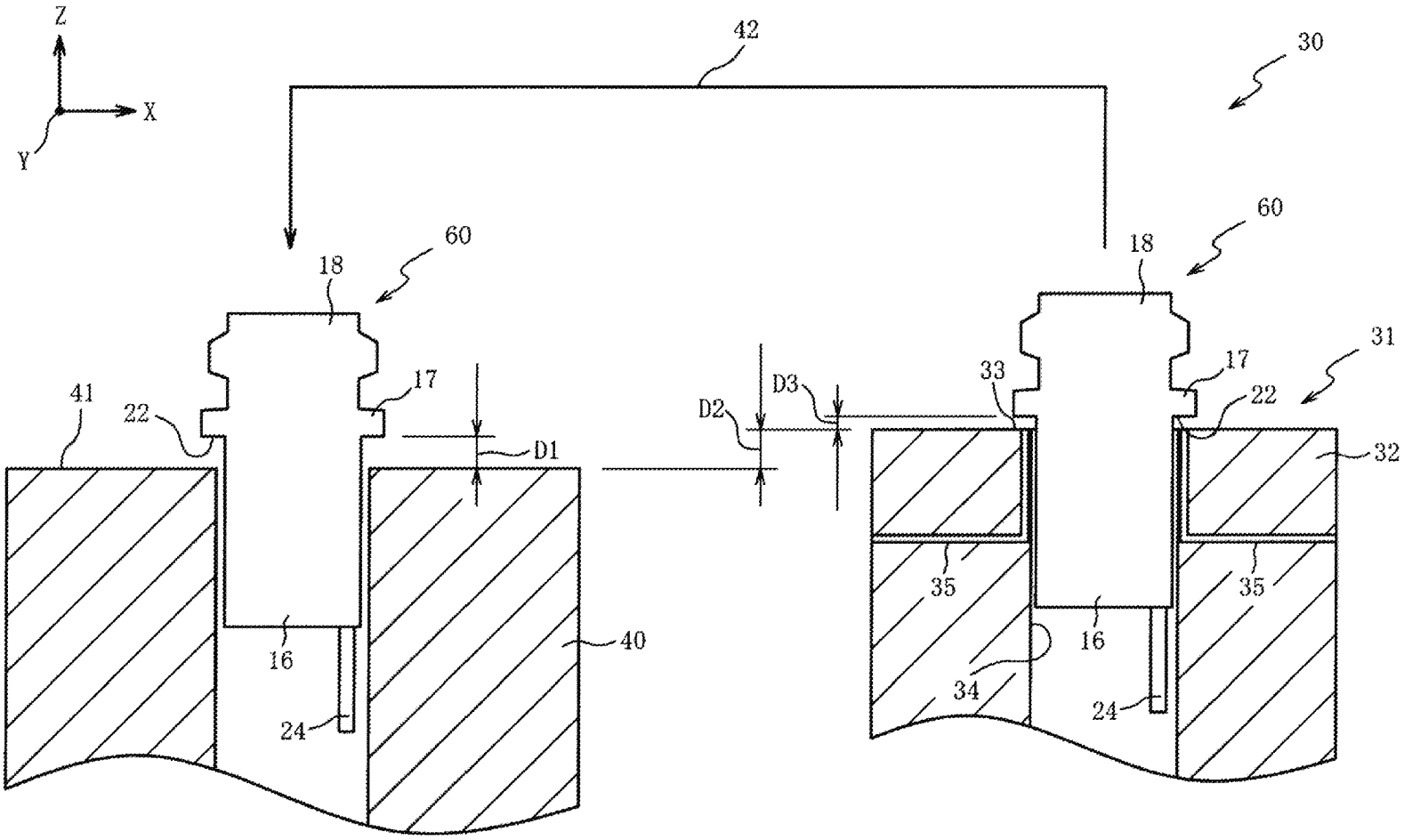
FIG. 3 is a schematic view showing the relationship between a base and dice.

The machining apparatus 30 according to one embodiment of the present invention will be described with reference to FIGS. 2 to 4. FIG. 2 is a schematic view of the machining apparatus 30. FIG. 3 is a schematic view showing the relationship between a base 32 and dice 40. Arrow head X and arrow head Y shown in FIG. 3 indicate the horizontal direction, and arrow head Z shown in FIG. 3 indicates the vertical direction orthogonal to the XY plane (the same applies in FIGS. 4A and 4B).

As shown in FIG. 2, the machining apparatus 30 is an apparatus for forming the external thread 21 (refer to FIG. 1) on the workpiece 60 through determining the start positions, in the circumferential direction and the axial direction, of the helix of the thread. In the workpiece 60, the axial portion 16, the flange portion 17, and the tube portion 18 are connected to each other in the axial direction from the front side toward the rear side. The ground electrode 24 is joined to the front end of the axial portion 16. The tube portion 18 and the ground electrode 24 of the workpiece 60 have not yet been bent, but are straight. The ground electrode 24 is joined so as to be positioned on a straight line which is parallel to the axis line O and which passes an alignment mark (not shown) such as a punch mark left on the tube portion 18. The machining apparatus 30 for machining the workpiece 60 includes a measuring device 31, dice 40, a conveying device 42, and a calculation device 50.

The measuring device 31 includes a base 32. The base 32 has a base reference surface 33 having a hole portion 34 formed therein. The inner diameter of the hole portion 34 is larger than the outer diameter of the axial portion 16 of the workpiece 60, but smaller than the outer diameter of the flange portion 17. The depth of the hole portion 34 is greater than a length obtained by combining the length of the axial portion 16 and the length of the ground electrode 24. Thus, when the axial portion 16 of the workpiece 60 is inserted in the hole portion 34, the workpiece reference surface 22 of the flange portion 17 is opposed to the base reference surface 33. In the present embodiment, the base 32 is disposed such that the base reference surface 33 faces upward in the vertical direction (Z direction).

The base reference surface 33 is a flat surface or a curved surface corresponding to the shape of the workpiece reference surface 22, and is formed so as to surround the hole portion 34. In the base 32, a flow path 35 (refer to FIG. 3) is formed, and an opening 36 of the flow path 35 is formed in the base reference surface 33. A pressure gauge 38 is connected to a pipe 37 which is connected to the flow path 35.

The pressure gauge 38 is a device for detecting the pressure of a fluid flowing through the flow path 35. An optimum pressure gauge may be appropriately selected as the pressure gauge 38 in accordance with the type of the fluid. For example, in a case where dry air, inert gas, or the like is used as the fluid, a semiconductor pressure sensor (silicon-made diaphragm) having a resistor formed therein is used as the pressure gauge 38. In a case where water or oil, non-dehumidified air, or the like is used as the fluid, a metallic diaphragm having a resistor formed therein is used as the pressure gauge 38. In the pressure gauge 38, a resistance value changes when a pressure of the fluid is applied to a diaphragm, whereby the pressure gauge 38 outputs an electric signal corresponding to the pressure. The pressure gauge 38 is connected to the calculation device 50.

The calculation device 50 detects the size of a gap D3 (refer to FIG. 3) in the axial direction between the base reference surface 33 and the workpiece reference surface 22 on the basis of a detection result from the pressure gauge 38, the gap D3 being obtained when the axial portion 16 of the workpiece 60 is inserted in the hole portion 34. In the present embodiment, positive-pressure gas (compressed air in the present embodiment) is supplied into the pipe 37, and the supplied gas flows out through the opening 36 of the flow path 35. When the gap D3 is small, the pressure detected by the pressure gauge 38 is high. When the gap D3 is large, the pressure detected by the pressure gauge 38 is low.

The dice 40 are tools for forming the external thread 21 (refer to FIG. 1) on the axial portion 16 of the workpiece 60 through rolling. In the present embodiment, the dice 40 are implemented as three cylindrical dice. Central axes (not shown) of the dice 40 face the vertical direction (Z direction), and end surfaces 41 of the dice 40 face upward in the vertical direction.

The workpieces 60 are arrayed by a workpiece supply device (not shown) such as a part feeder in a state where the workpieces 60 are equal to one another in terms of the position, in the circumferential direction, of the ground electrode 24 relative to the axial portion 16. Thereafter, the tube portion 18 of each of the workpieces 60 is held by a chuck (not shown), and the axial portion 16 of the workpiece 60 is inserted in the hole portion 34 of the base 32.

In the machining apparatus 30, the conveying device 42 frictionally holds the workpiece 60 inserted in the hole portion 34 of the base 32, and thereafter, the measuring device 31 measures the gap D3 (refer to FIG. 3) between the workpiece reference surface 22 and the base reference surface 33, and the conveying device 42 conveys the workpiece 60 to the dice 40. The conveying device 42 includes: a chuck 43; a rotation unit 46 which rotates the chuck 43 about the central axis of the chuck 43; and a movement unit 47 which moves the chuck 43 and the rotation unit 46 in the vertical direction (Z direction) and the horizontal direction (XY direction).

The chuck 43 includes: an insertion portion 44 to be inserted in the tube portion 18 of the workpiece 60; and a protrusion portion 45 connected to the insertion portion 44. The movement unit 47 lowers the chuck 43 in the vertical direction until the protrusion portion 45 comes into contact with an end portion of the tube portion 18, so that the insertion portion 44 of the chuck 43 is inserted in the tube portion 18 of the workpiece 60. After being inserted in the tube portion 18 of the workpiece 60, the insertion portion 44 causes a clamp pin (not shown) to protrude toward the inner circumference of the tube portion 18, to frictionally hold the tube portion 18.

Position alignment in the circumferential direction between the workpiece 60 and the chuck 43 is performed through rotation of the rotation unit 46 by use of the alignment mark (not shown) such as a punch mark left on the tube portion 18 correspondingly to the position of the ground electrode 24. By the position alignment, in the circumferential direction, of the chuck 43 being performed relative to the dice 40, a start position, in the circumferential direction, of the helix of the external thread 21 (refer to FIG. 1) (cutting-start position of the thread) can be determined.

After moving, in the Z direction, the chuck 43 of which the insertion portion 44 frictionally holds the tube portion 18, and drawing out the axial portion 16 of the workpiece 60 from the hole portion 34, the movement unit 47 moves the chuck 43 in a direction toward the dice 40. The movement unit 47 disposes the workpiece 60 at a target position, in the axial direction, relative to the dice 40 which is calculated by the calculation device 50. The rotation unit 46 rotates the workpiece 60 via the chuck 43 in a direction opposite to the direction of rotations of the dice 40 in synchronization with the rotations of the dice 40. Upon formation of the external thread 21 (refer to FIG. 1) by the dice 40, the conveying device 42 moves the chuck 43 in a direction away from the dice 40 while rotating the chuck 43, and takes out the workpiece 60 having the external thread 21 formed thereon from the end surface 41 side of the dice 40.

The relationship between the base reference surface 33 of the base 32 and the dice 40 will be described with reference to FIG. 3. For easy understanding, FIG. 3 shows, regarding the workpiece 60, the outer shape thereof, and shows, regarding the conveying device 42, a trajectory of the chuck 43 (refer to FIG. 2) conveying the workpiece 60 from the base 32 to the dice 40 while frictionally holding the workpiece 60.

As shown in FIG. 3, after frictionally holding the workpiece 60, the conveying device 42 disposes the workpiece 60 at a target position, in the axial direction (Z direction), relative to the dice 40 which is calculated by the calculation device 50 (refer to FIG. 2). The target position is a position, of the workpiece reference surface 22 of the workpiece 60, which is spaced in the axial direction (Z direction) from the end surfaces 41 of the dice 40 by a distance D1. By the dice 40 being engaged with the axial portion 16 of the workpiece 60 disposed at the target position, the start position, in the axial direction, of the helix of the external thread 21 (refer to FIG. 1) (cutting-start position of the thread) can be made constant.

Here, a distance D2, in the axial direction (Z direction) of the dice 40, between the base reference surface 33 and the end surfaces 41 of the dice 40 is set to a known size. Since each of the dice 40 rotates about the central axis (not shown), a clearance is set in the axial direction (Z direction). However, since the end surface 41 of the die 40 faces upward in the vertical direction, the die 40 is positioned at the lower end of the clearance due to the own weight thereof. Thus, the position, in the axial direction (Z direction), of the end surface 41 of the die 40 can be made constant.

For each workpiece 60, the measuring device 31 measures the gap D3, in the axial direction (Z direction), between the workpiece reference surface 22 and the base reference surface 33. For each workpiece 60, the calculation device 50 (refer to FIG. 2) obtains an amount of movement, in the axial direction (Z direction), of the conveying device 42 on the basis of the preset distances D1, D2, and the measured gap D3. For each workpiece 60, the gap D3 is measured, and the amount of movement, in the axial direction (Z direction), of the conveying device 42 is calculated on the basis of the gap D3. Consequently, the conveying device 42 can dispose the workpiece 60 at the target position, of the flange portion 17, which is spaced from the dice 40 by the distance D1.

As described above, for each workpiece 60, the position alignment in the circumferential direction between the workpiece 60 and the conveying device 42 (chuck 43) is performed by use of the alignment mark (not shown) left on the tube portion 18. Thus, for each workpiece 60, the machining apparatus 30 allows the start positions, in the circumferential direction and the axial direction, of the helix of the external thread 21 (refer to FIG. 1) (cutting-start positions of the thread) to be constant.

Next, an example of detection of the gap D3 in the axial direction between the base reference surface 33 and the workpiece reference surface 22 will be described with reference to FIGS. 4A and 4B and FIGS. 5A and 5B. FIGS. 4A and 5A are each a sectional view schematically showing one workpiece 60 disposed in the base 32. FIGS. 4B and 5B are each a sectional view schematically showing another workpiece 60 disposed in the base 32.

Figures 4A, 4B:
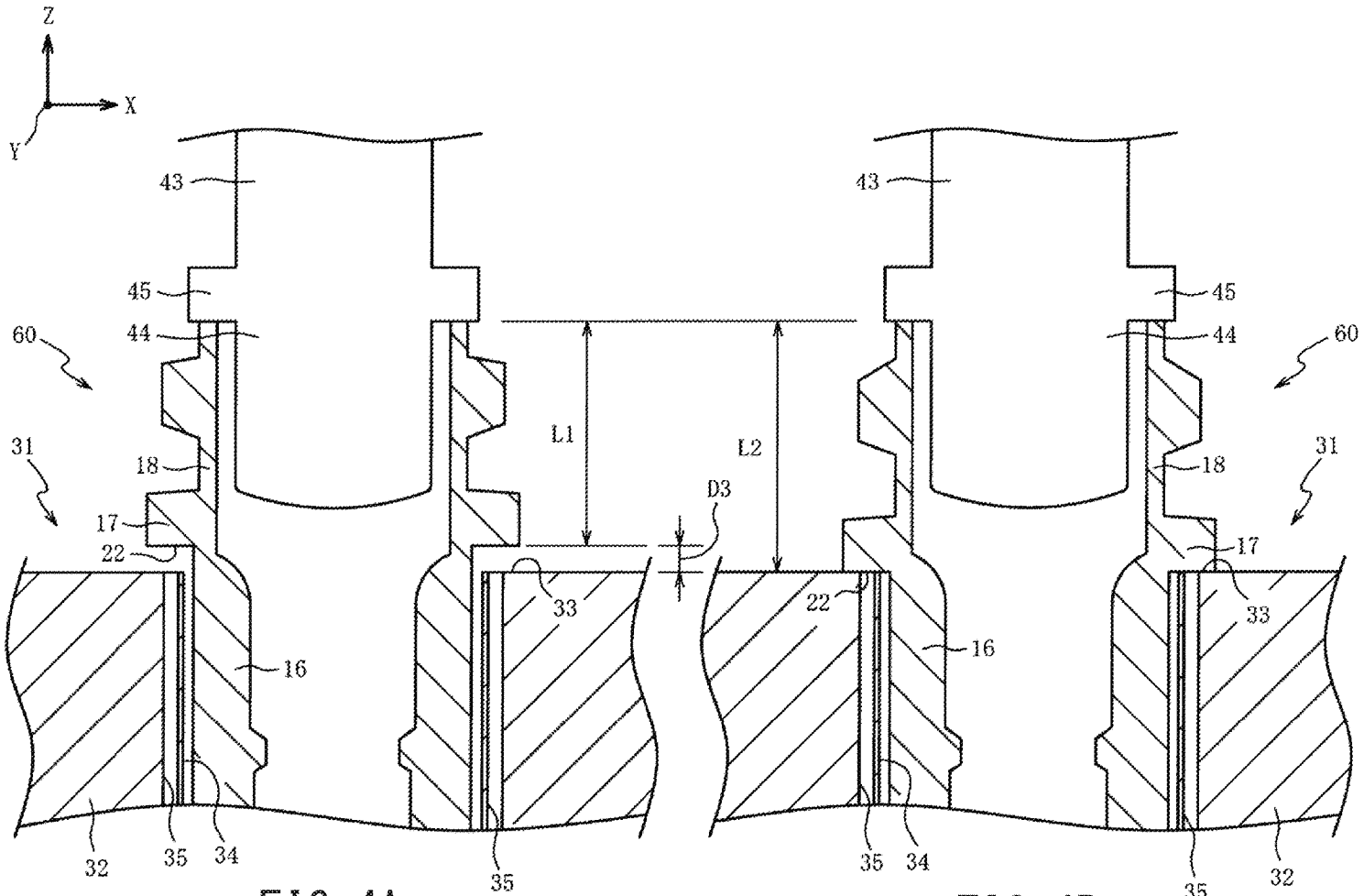
FIG. 4A is a sectional view schematically showing one workpiece disposed at the base.
FIG. 4B is a sectional view schematically showing another workpiece disposed at the base.
Figure 5A:
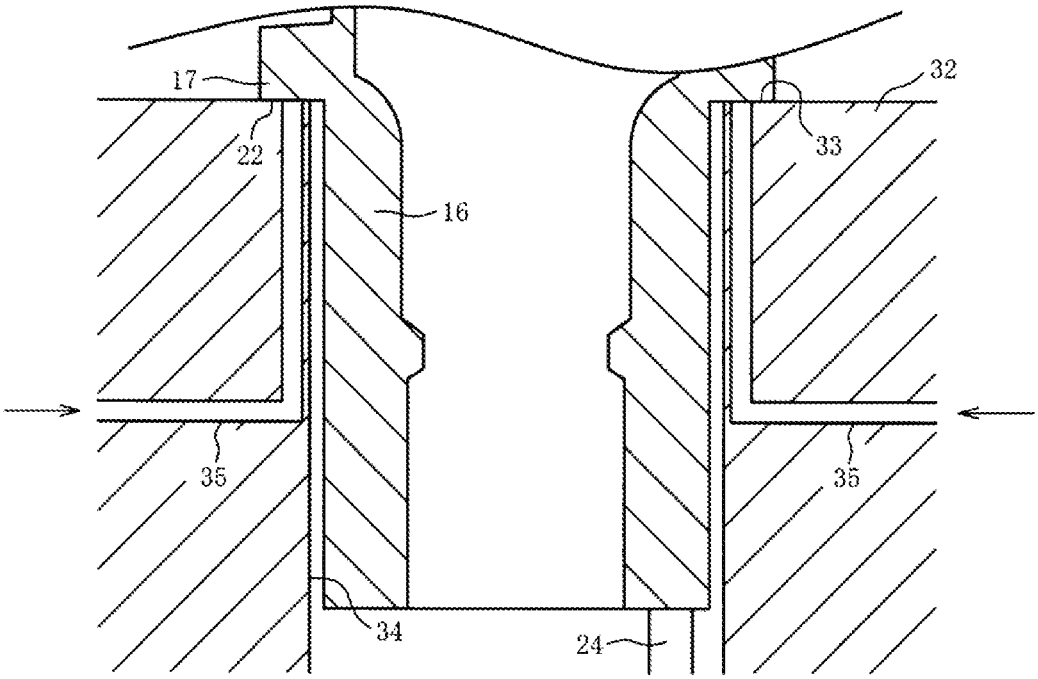
FIG. 5A is a sectional view schematically showing one workpiece disposed at the base.
Figure 5B:
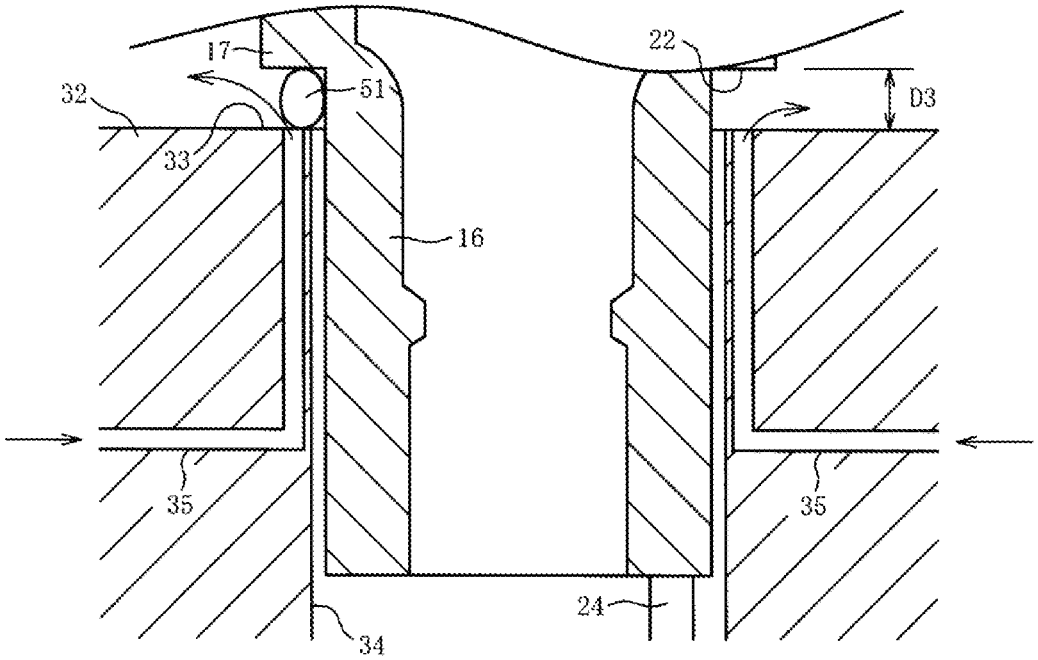
FIG. 5B is a sectional view schematically showing another workpiece disposed at the base.

As shown in FIGS. 4A and 4B, in a case where the gap D3 between the workpiece reference surface 22 and the base reference surface 33 is measured in a state where the protrusion portion 45 of the chuck 43 is in contact with the end portion of the tube portion 18 of each workpiece 60, even if the amount of movement (lowering amount) of the chuck 43 toward the base 32 is set to a constant value, the size of the gap D3 varies when lengths L1, L2, in the axial direction, of the tube portions 18 of the workpieces 60 are different from each other. The one workpiece 60 of which the tube portion 18 has the shorter length L1 (refer to FIG. 4A), has a larger gap D3 than the another workpiece 60 of which the tube portion 18 has the longer length L2. Since being capable of detecting the gap D3 even when there is variation in the length of the tube portion 18 of the workpiece 60, the measuring device 31 can accurately detect the distance D1 from the dice 40 to the flange portion 17 on the basis of the gap D3 and the amount of movement (lowering amount) of the chuck 43.

As shown in FIG. 5B, in a case where a foreign object 51 (e.g., machining chip, spatters, or the like) is adhered to the workpiece reference surface 22, since the foreign object 51 is interposed between the base reference surface 33 and the workpiece reference surface 22, the size of the gap D3 cannot be made smaller than the size of the foreign object 51. Meanwhile, as shown in FIG. 5A, in a case where the workpiece reference surface 22 is clean, the workpiece reference surface 22 can be brought into close contact with the base reference surface 33. Since detecting the size of the gap D3 by use of a fluid flowing through the flow path 35, the measuring device 31 can accurately detect the gap D3 between the base reference surface 33 and the workpiece reference surface 22 regardless of whether or not a foreign object 51 is present.

Meanwhile, in a case where the workpiece reference surface 22 is detected by use of a jig or an optical sensor, there is a possibility that the position of the lower end of a foreign object 51 is erroneously determined to be the position of the workpiece reference surface 22. When such erroneous determination occurs, a problem arises that the cutting-start position of the external thread 21 (refer to FIG. 1) is shifted in the axial direction by the size of the foreign object 51. According to the present embodiment, since the gap D3 between the base reference surface 33 and the workpiece reference surface 22 can be accurately detected regardless of whether or not a foreign object 51 is present, the accuracy for the cutting-start position of the external thread 21 (refer to FIG. 1) can be improved.

A removable foreign object 51 such as machining dust adhered to the workpiece reference surface 22 does not cause any problem since the removable foreign object 51 is removed in, for example, a cleaning step that is a later step. Since the measuring device 31 causes positive-pressure gas to flow out through the opening 36 in the base 32, it can also be expected that the foreign object 51 such as machining dust adhered to the workpiece reference surface 22 is removed by the gas. Meanwhile, the metal shell 15, of which the workpiece reference surface 22 has an unremovable foreign object 51 such as a spatter adhered thereto, is removed in, for example, an inspection step that is a later step. Thus, no spark plug 10 having a foreign object 51 adhered thereto is to be shipped.

As described above, although the present invention has been described based on the embodiment, the present invention is not limited to the above embodiment at all. It can be easily understood that various modifications can be devised without departing from the gist of the present invention.

In the embodiment described above, the spark plug 10 is described in which the gasket 23 is disposed on the workpiece reference surface 22 of the metal shell 15. However, the present invention is not necessarily limited thereto. In a case where the spark plug 10 is of a conical seal type, the gasket 23 can be omitted with the workpiece reference surface 22 being a tapered surface. In this case, a target position (distance D1) can be set without taking into consideration the thickness of the gasket 23.

In the embodiment described above, the measuring device 31 is described which measures the gap D3 by use of compressed air (positive-pressure gas). However, the present invention is not necessarily limited thereto. As a matter of course, nitrogen gas, inert gas, or the like may be used, instead of compressed air, as a fluid. Either dry gas or non-dehumidified gas may be used as the gas. As a matter of course, a liquid such as water or oil may be used, instead of gas, as the fluid. As a matter of course, a negative pressure generated by suction of air from the opening 36 formed in the base reference surface 33 may be used. As a matter of course, the pressure gauge 38 can be appropriately selected in accordance with the fluid to be used.

In the embodiment described above, the pressure gauge 38 is described which detects the pressure of a fluid by use of change in a resistance value. However, the present invention is not necessarily limited thereto. As a matter of course, a pressure gauge 38 which measures a pressure by detecting change in electrostatic capacity instead of the resistance value, may be used.

In the embodiment described above, a case is described where the external thread 21 is formed, through rolling, by the workpiece 60 being rotated in a direction opposite to the direction of rotations of the dice 40 in synchronization with the rotations of the dice 40. However, the present invention is not necessarily limited thereto. As a matter of course, other methods may be adopted. Other methods include, for example, positioning rolling.

In the embodiment described above, a case is described where three cylindrical dice are used as the dice 40. However, the present invention is not necessarily limited thereto. As a matter of course, for example, two cylindrical dice or flat dice, or a combination of a segment die and a flat die, may be used as the dice 40.

In the embodiment described above, a case is described where the end surfaces 41 of the dice 40 are positioned downward, in the vertical direction (Z direction), of the base reference surface 33. However, the present invention is not necessarily limited thereto. The present invention can be implemented as long as the distance D1 between the base reference surface 33 and the end surfaces 41 of the dice 40 is known. Thus, setting may be appropriately performed by, for example, positioning the end surfaces 41 of the dice 40 upward, in the vertical direction (Z direction), of the base reference surface 33, or causing the base reference surface 33 and the end surfaces 41 of the dice 40 to be level with each other.

In the embodiment described above, a case is described where the base 32 and the dice 40 are disposed such that the base reference surface 33 and the end surfaces 41 of the dice 40 face upward in the vertical direction. However, the present invention is not necessarily limited thereto. The orientations of the base reference surface 33 and the end surfaces 41 of the dice 40 may be appropriately set.

In the embodiment described above, a case is described where the gap D3 is measured and the workpiece 60 is conveyed to the dice 40, in a state where the protrusion portion 45 of the chuck 43 is in contact with the end portion of the tube portion 18 of the workpiece 60. However, the present invention is not necessarily limited thereto. The protrusion portion 45 of the chuck 43 does not need to be brought into contact with the end portion of the tube portion 18 of the workpiece 60 in a case where the distance D1 is calculated by taking into consideration: the amount of movement, relative to a reference position on the conveying device 42, performed by the chuck 43 when the workpiece 60 inserted in the hole portion 34 of the base 32 is held; and the amount of movement, relative to the reference position on the conveying device 42, performed by the chuck 43 when the held workpiece 60 is disposed on the dice 40.

In the embodiment described above, the machining apparatus 30 is described which forms, through rolling, the external thread 21 on the workpiece 60 for making therefrom the metal shell 15 of the spark plug 10. However, the present invention is not necessarily limited thereto. As a matter of course, the machining apparatus 30 may be applied in a case where the external thread 21 is machined on a workpiece, for other components than the metal shell 15, which includes the axial portion 16 and the flange portion 17. Other components include, for example, a gas-piping component or a liquid-piping component, and a plug, for a tube or the like, which is attached to a container for sealing gas or liquid therein and which allows the gas or liquid to flow into the container and to be sealed therein after the inflow.

In the embodiment described above, a case is described where the ground electrode 24 joined to the metal shell 15 is bent. However, the present invention is not necessarily limited thereto. As a matter of course, a straight ground electrode 24 may be used instead of the bent ground electrode 24. In this case, a front side portion of the metal shell 15 is caused to extend in the axis line O direction, the straight ground electrode 24 is joined to the metal shell 15, and the distal end 26 of the ground electrode 24 is caused to oppose the center electrode 13.

In the embodiment described above, a case is described where the ground electrode 24 is disposed such that the distal end 26 of the ground electrode 24 and the center electrode 13 are opposed to each other on the axis line O. However, the present invention is not necessarily limited thereto. The positional relationship between the ground electrode 24 and the center electrode 13 may be appropriately set. As another example of the positional relationship between the ground electrode 24 and the center electrode 13, the ground electrode 24 may be disposed such that a side surface of the center electrode 13 and the distal end 26 of the ground electrode 24 are opposed to each other.

DESCRIPTION OF REFERENCE NUMERALS

10 spark plug
11 insulator
12 axial hole
13 center electrode
15 metal shell (component)
16 axial portion
17 flange portion
21 external thread
22 workpiece reference surface
24 ground electrode
25 proximal end
26 distal end
30 machining apparatus
31 measuring device
32 base
33 base reference surface
40 dice
42 conveying device
50 calculation device
60 workpiece
D1 distance (target position)
D2 distance
D3 gap Having described the invention, the following is claimed:

1. A machining apparatus configured to form, through rolling, an external thread on an axial portion of a workpiece which includes the axial portion, and a flange portion protruding in an axial orthogonal direction orthogonal to an axial direction of the axial portion so as to be flange-shaped, the machining apparatus comprising:

a measuring device which includes a base having a base reference surface to which a workpiece reference surface, on an axial portion side, of the flange portion is opposed, the measuring device being configured to measure a gap in the axial direction between the base reference surface and the workpiece reference surface by use of a fluid flowing between the base reference surface and the workpiece reference surface, in a state where the workpiece reference surface is opposed to the base reference surface;

dice configured to form the external thread on the axial portion toward a direction away from the flange portion through rolling, a distance in the axial direction from the base reference surface to the dice being known;

a calculation device configured to obtain a target position, in the axial direction, of the workpiece to be disposed on the dice, on the basis of the distance and the gap; and a conveying device configured to convey the workpiece to the target position obtained by the calculation device.

2. The machining apparatus according to claim 1, wherein positive-pressure gas is used as the fluid.

3. A component producing method for forming, through rolling, an external thread on an axial portion of a workpiece which includes the axial portion, and a flange portion protruding in an axial orthogonal direction orthogonal to an axial direction of the axial portion so as to be flange-shaped, the method comprising:

a surface-opposing step for causing a workpiece reference surface, on an axial portion side, of the flange portion to oppose a base reference surface of a base;

a measurement step for measuring a gap in the axial direction between the base reference surface and the workpiece reference surface by use of a fluid flowing between the base reference surface and the workpiece reference surface, in a state where the workpiece reference surface is opposed to the base reference surface;

a calculation step for obtaining a target position, in the axial direction, of the workpiece to be disposed on dice, a distance to which in the axial direction from the base reference surface is known, on the basis of the distance and the gap;

a conveyance step for conveying the workpiece to the target position; and a rolling step for forming, through rolling performed by the dice, the external thread on the axial portion of the workpiece disposed at the target position, toward a direction away from the flange portion.

4. A method for producing a spark plug including: an insulator having therein an axial hole extending in an axis line direction; a center electrode disposed in the axial hole so as to protrude from a front end of the insulator; a metal shell surrounding a periphery of the insulator; and a ground electrode provided such that a proximal end thereof is connected to a front end of the metal shell and such that a distal end thereof is opposed to a tip of the center electrode with a gap being retained therebetween, wherein as the metal shell, a metal shell produced by the component producing method according to claim 3 is used.

* * * * *